US005242160A

United States Patent [19]

Girard et al.

[11] Patent Number: 5,242,160

[45] Date of Patent: Sep. 7, 1993

[54] PORTABLE BACKSTOP

[75] Inventors: Thomas I. Girard, St. Louis, Mo.; Jon A. Glydon, West Barnstable, Mass.

[73] Assignee: Indoor Activities Unlimited, Inc., St. Louis, Mo.

[21] Appl. No.: 846,741

[22] Filed: Mar. 6, 1992

Related U.S. Application Data

[63] Continuation of Ser. No. 701,840, May 17, 1991, abandoned.

[51] Int. Cl.[5] ..... A63B 69/00

[52] U.S. Cl. ..... 273/26 A

[58] Field of Search ..... 273/26 A, 55 R, 55 B, 273/181 A, 407

[56] References Cited

U.S. PATENT DOCUMENTS

| | | | |
|---|---|---|---|
| 1,116,555 | 11/1914 | Brewster | 273/181 A |
| 3,035,838 | 5/1962 | Johnston | 273/407 |
| 3,820,787 | 6/1974 | Heinbinger | 273/55 B |
| 3,822,883 | 7/1974 | Devos | 273/26 A |
| 3,918,711 | 11/1975 | Zak | 273/26 A |
| 3,929,334 | 12/1975 | Magazzu | 273/26 A |
| 4,068,846 | 1/1978 | Forrest | 273/181 A |
| 4,497,485 | 2/1985 | Macosko | 273/407 |
| 4,762,319 | 8/1988 | Krumholz | 273/55 R |
| 4,863,166 | 9/1989 | Becera | 273/26 A |
| 4,883,272 | 11/1989 | Lay | 273/26 A |
| 4,905,996 | 3/1990 | Tallent | 273/26 A |
| 5,037,095 | 8/1991 | Nedwick | 273/55 R |

*Primary Examiner*—Theatrice Brown

*Attorney, Agent, or Firm*—Dickinson, Wright, Moon, Van Dusen & Freeman

[57] ABSTRACT

A portable backstop has a vertically upstanding inverted first U-shaped frame including legs supported on a base and a second, smaller, U-shaped frame pivoted from an intermediate point of the legs of the inverted U-shaped frame. The frames support a bag-shaped mesh net for receiving a ball. When the backstop is unfolded for use, the second U-shaped frame extends outward and the net, attached around the upper perimeter of the frames, forms a pocket for receiving a ball. The second U-shaped frame folds upward against the first frame for transportation and storage. The backstop may be used indoors or outdoors.

5 Claims, 3 Drawing Sheets

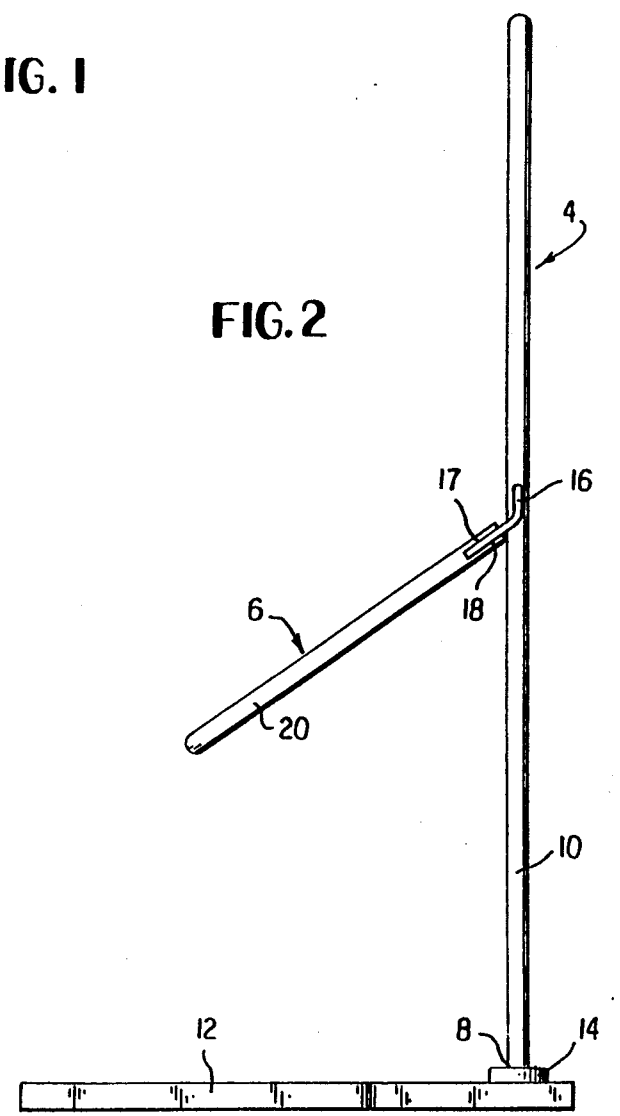
FIG. 2
FIG. 1
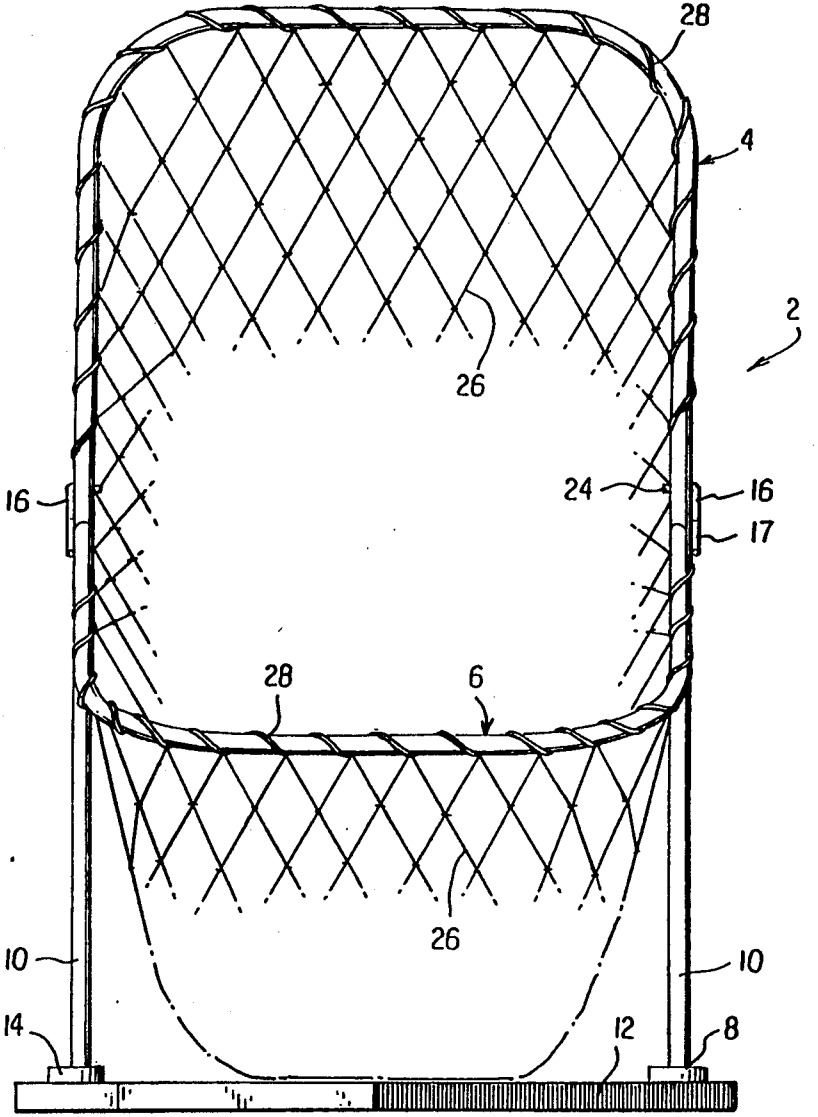

PORTABLE BACKSTOP

This is a continuation of U.S. application Ser. No. 07/701,840, filed May 17, 1991 now abandoned.

FIELD OF THE INVENTION

The invention relates to sports accessories, particularly to portable backstops for ball games.

BACKGROUND OF THE INVENTION

Known portable backstops are bulky and cumbersome. Thayer, U.S. Pat. No. 1,208,235, describes an elevated net basket for receiving a croquet ball. The basket includes a pair of uprights inserted into the ground and a pair of U-shaped frames for supporting a ball-receiving net. The frames and uprights are connected together at the extremities of each arm of the U-shaped frame members and the upper ends of the uprights.

Blees, U.S. Pat. No. 2,895,737 describes a ball catching device having an inverted U-shaped net-supporting frame inserted into a base (FIG. 4). The net is stretched around the U-shaped frame. Bay et al., U.S. Pat. No. 4,127,267, describes a collapsible frame for receiving a ball arresting net. Shieh, U.S. Pat. No. 4,489,941, also describes a collapsible sports net and frame. Two rectangular frames are hinged together to form either a rectangular back stop or a planar back stop when the frames are positioned vertically one above the other.

Vinzetta, U.S. Pat. No. 4,723,780, describes a practice device including a single net enclosure into which golf balls may be driven. A U-shaped canopy is pivotally attached to the upper ends of vertical support members. Vinzetta does not describe a catching basket. Tallent et al., U.S. Pat. No. 4,905,996, describes a target net having a rectangular framework supporting a net within the framework. An inner target net is secured by straps to the main net portion of the apparatus to provide a target zone within the framework. The target net has straps secured between upper and lower members of the framework.

Hailer et al., U.S. Pat. No. 4,932,657, describes a sports training device for receiving balls in an open target area. The device has a fixed frame having a large rectangular frame at the back and a small, ball receiving net in front of the rectangular frame. A ball is thrown, hit or kicked into the target area and, if the receiving net is missed, the larger rear frame stops the ball. The frame is made of fixed rigid members.

SUMMARY OF THE INVENTION

A portable backstop of the invention includes a tubular frame and a net suspended from the frame for catching a ball. The frame includes two U-shaped portions which are opened to form a bag-shaped catching device in use and folded together compactly when not in use. The backstop is supported by a base and is easily transported for indoor or outdoor use.

The backstop includes a first U-shaped frame member and a second U-shaped frame member pivoted at ends of its legs at an intermediate position of respective legs of the first U-shaped frame member. The first U-shaped member is inverted and ends of its legs are inserted in a base for supporting the backstop. The second U-shaped member is secured to the first U-shaped member by two pivot members welded to ends of legs of the second U-shaped member and inserted through respective legs of the first U-shaped member. Alternatively, the second U-shaped member may include J-shaped pivot members inserted through apertures in respective legs of the first U-shaped frame members and through ends of respective legs of the second U-shaped member. Remote ends of the J-shaped pivot members are fitted into apertures in respective legs of the first U-shaped member. The second U-shaped member is able to pivot between an upper folded position and a lower open position.

It is an object of the invention to provide a folding portable backstop for indoor or outdoor use.

BRIEF DESCRIPTION OF THE DRAWINGS

FIG. 1 is a front elevational view of a portable backstop of the invention, extended for use, with the netting partially cut away.

FIG. 2 is a side elevational view of a portable backstop, in extended position, without the netting.

DETAILED DESCRIPTION OF THE INVENTION

Figure 6:
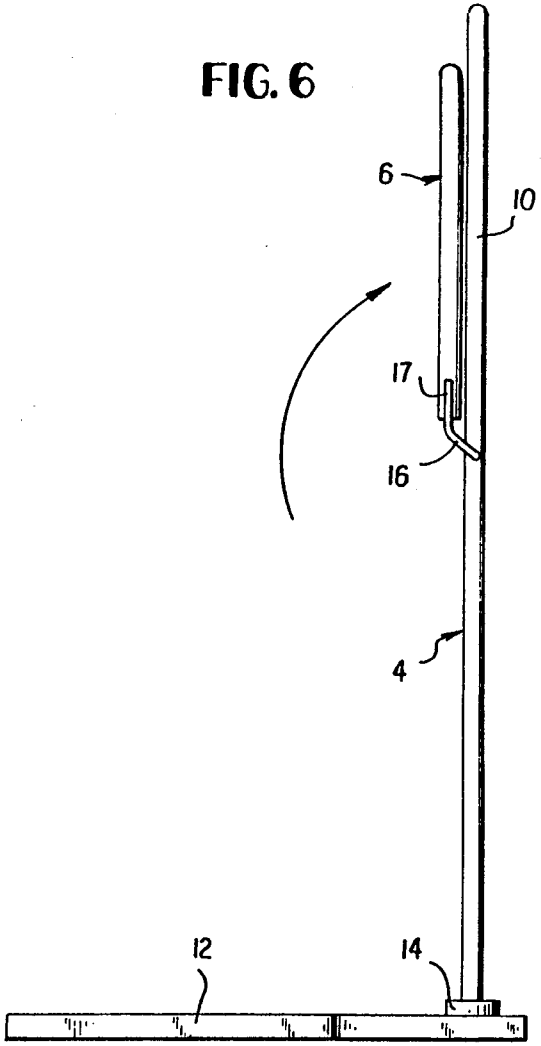
FIG. 6 is a side elevational view of a portable backstop in folded position, without the netting.
Figure 3:
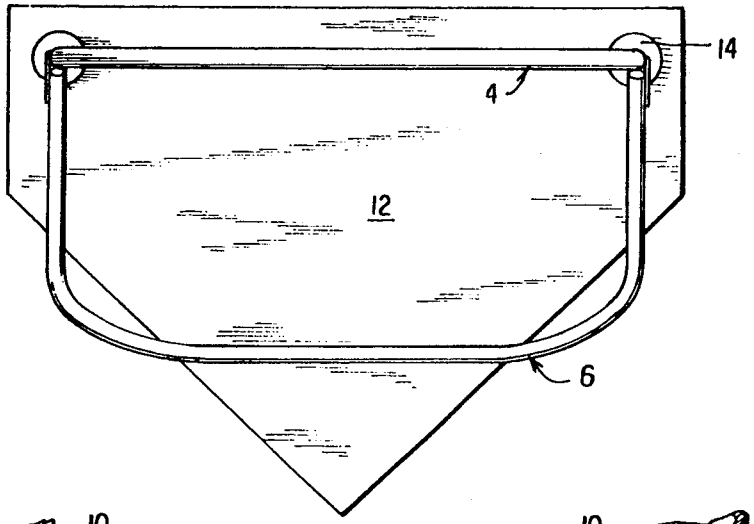
FIG. 3 is a top view of a portable backstop of FIG. 2.
Figure 5:
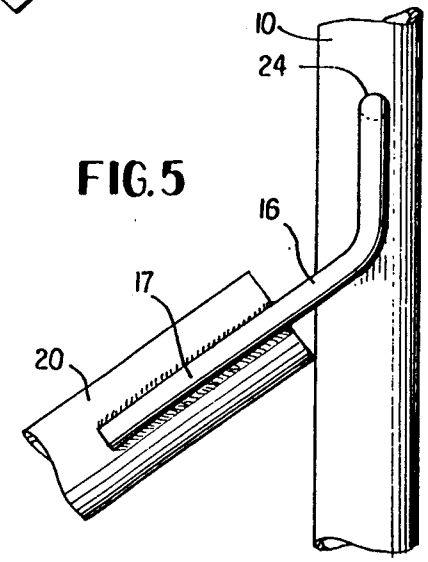
FIG. 5 is a side elevational view of the joint of FIG. 4.
Figure 4:
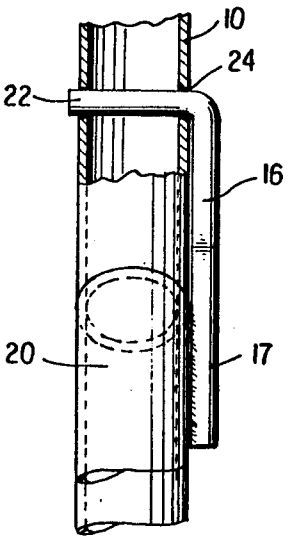
FIG. 4 is a detail of a joint between the two U-shaped frames of a portable backstop, shown partly in cross-section.

A portable backstop is useful for playing ballgames when the number of players is not sufficient to have a catcher. A portable backstop of the invention may also be used for pitching practice, either with a hitter or without a hitter. The backstop of the invention catches and holds the ball in the net attached to the upper perimeter of the frame and does not allow the ball to rebound dangerously. The netting hangs loosely and is large enough to hang to the ground or to hang down sufficiently to hold balls without rebounding. The backstop is suitable for indoor or outdoor use.

With reference to FIGS. 1 to 8, in which like numerals represent like parts, FIGS. 1 and 2 illustrate portable backstop 2 having first U-shaped frame 4 and second U-shaped frame 6. First U-shaped frame 4 is inverted and lower ends 8 of legs 10 are inserted into base 12. Washers 14 secure leg ends 8 into base 12.

Second U-shaped frame 6 is pivotably extended from an intermediate point on each of legs 10 of first U-shaped frame 4 by pivot members 16. As shown in detail in FIGS. 4 and 5, first ends 17 of pivot members 16 are welded to terminal ends 18 of legs 20 of second U-shaped member 6. Second ends 22 of pivot members 16 extend through apertures 24 at an intermediate point on each of legs 10. Second U-shaped member 6 pivots about aperture 24 between an extended position shown in FIG. 2 and a folded position, used for transportation and storage, shown in FIG. 6.

Netting 26 is bag-shaped and is attached at its upper perimeter around the upper portion of inverted first U-shaped member 4, above aperture 24, and around the length of second U-shaped member 6, as shown in FIG. 1. The upper perimeter of the mesh netting 26 may be attached to frame 2 by twine 28 wrapped around the described portions of frame 2 or the netting may be attached to the frame using adhesive tape. Other known methods of attaching a netting bag to a frame may be used.

Figure 8:
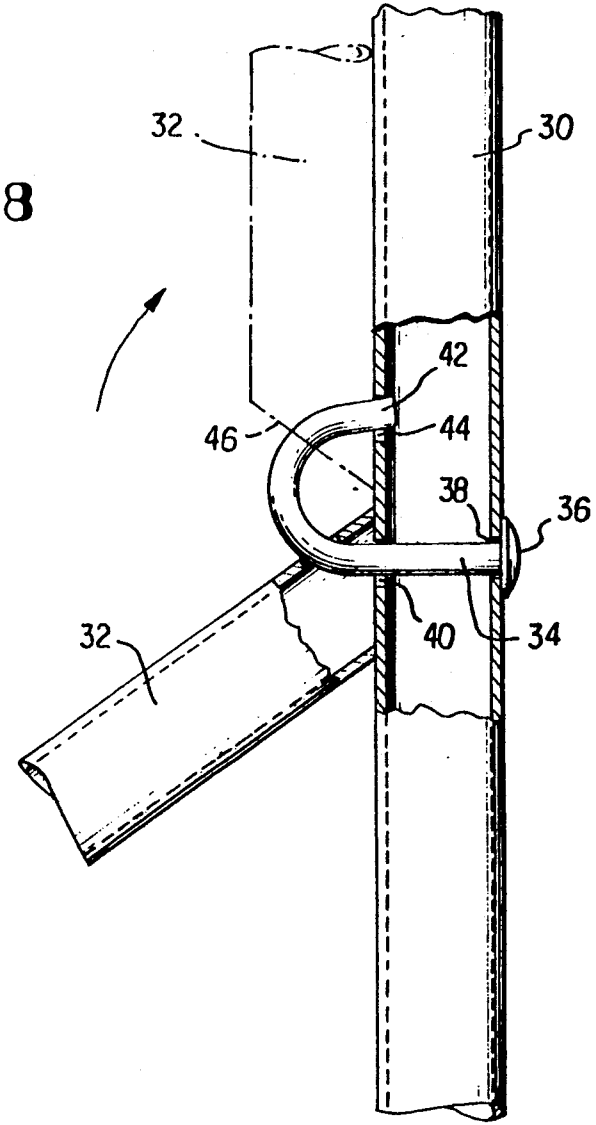
FIG. 8 is a side elevational view of the joint of FIG. 4.
Figure 7:
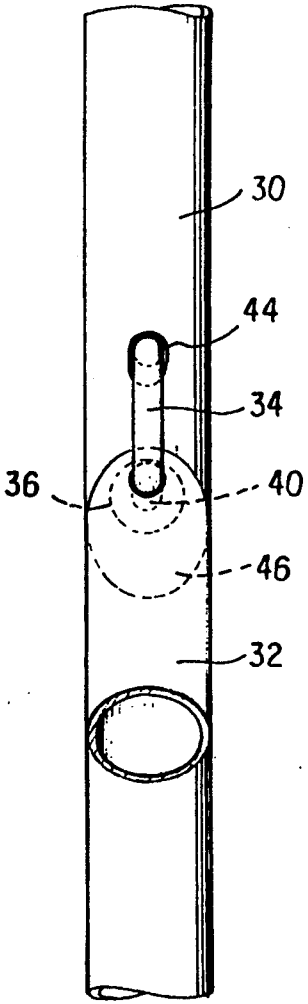
FIG. 7 is a detail of another joint between the two U-shaped frames of a portable backstop, shown partly in cross-section.

FIGS. 7 and 8 illustrate an alternative method of attaching and pivoting U-shaped frame members 30 and 32. J-shaped pivot member 34, having head 36 at one end, is inserted through apertures 38 and 40 in member 30. The remote end of member 34 is bent in a J-shape so that on squeezing the ends together, end 42 is pressed into aperture 44 in member 30. J-shaped pivot member 34 is held in position in aperture 44 by compression of the curved member. Frame member 32 pivots around J-shaped member 34 betWeen a lower position illustrated in solid lines in FIG. 8 and an upper position shown in phantom in FIG. 8. End 46 of member 32 is preferably cut diagonally, as shown in FIG. 8.

In a typical non-limiting embodiment of the invention, the frame members may be rigid metal or plastic tubing of 1 to 1½ inch diameter, tne pivot members are steel, the netting may be nylon netting of 2 to 3 inch mesh and the base may be of sheet metal, plastic or wood. The base must be sufficiently heavy to provide stability for the backstop in use, but light enough to be carried from place to place as needed for use. The frame and base may be painted ir required, and may be provided with feet for protecting the floor, for indoor use.

In use, the backstop is unfolded and set up, either indoors or outdoors, in position for catching a pitch. After use, the backstop is folded for transportation and/or storage.

While the invention has been described with respect to certain embodiments thereof, it will be appreciated that variations and modifications may be made without departing from the spirit and scope of the invention.

What is claimed is:

1. A portable backstop comprising a first vertically extending U-shaped frame member and a second U-shapes frame member, each leg of said second U-shaped frame member having its free end pivotally attached adjacent the free end of a respective leg of said first U-shaped frame member: said first U-shaped member being inverted such that the ends thereof are inserted into a base to support said backstop vertically; said second U-shaped frame member being pivotable between an upper folded position substantially parallel to said first U-shaped member and a lower open position at an acute angle to the horizontal; netting means comprising a single continuous net having a first portion thereof attached to and extending between the legs of said first U-shaped frame member and a second portion thereof attached to and extending between the legs of said second U-shaped frame member to define a projectile stop, said netting means second portion being bag-shaped to retain a ball falling therein which has been stopped by said first portion.

2. A portable backstop according to claim 1 wherein said pivot members are secured to said second U-shaped frame member by welding.

3. A portable backstop according to claim 1 wherein said pivot means is J-shaped and inserted through each leg of said first U-shaped member and through to end of each leg of said second U-shaped member.

4. A portable backstop according to claim 3 wherein the end of each leg of said second U-shaped member is cut diagonally.

5. A frame for a portable backstop comprising a first U-shaped frame member and a second U-shaped frame member pivoted at ends of legs thereof at an intermediate position of respective legs of the said first U-shaped frame member, wherein said first U-shaped member is inverted and ends of said legs thereof are inserted in a base for supporting said backstop and wherein said second U-shaped member is secured to said first U-shaped member by two J-shaped pivot members each pivot member being inserted through a respective leg of said first U-shaped member and through the end of a respective leg of said second U-shaped member.

* * * * *

UNITED STATES PATENT AND TRADEMARK OFFICE

CERTIFICATE OF CORRECTION

PATENT NO. : 5,242,160

DATED : September 7, 1993

INVENTOR(S) : Thomas L. GIRARD et al.

It is certified that error appears in the above-identified patent and that said Letters Patent is hereby corrected as shown below:

On the Title Page, Item [75];

Please correct the printed name of the inventor from "Thomas I. Girard" to --Thomas L. Girard--.

Signed and Sealed this

Thirty-first Day of May, 1994

*Attest:*

*Attesting Officer*

BRUCE LEHMAN

*Commissioner of Patents and Trademarks*